US007404499B1

(12) United States Patent
Ramsey

(10) Patent No.: US 7,404,499 B1
(45) Date of Patent: Jul. 29, 2008

(54) TRASHCAN ASSEMBLY INCLUDING BAG ENGAGING MEMBER

(75) Inventor: Franklin M. Ramsey, Charlotte, NC (US)

(73) Assignee: Pressix Technologies, LLC, Charlotte, NC (US)

( * ) Notice: Subject to any disclaimer, the term of this patent is extended or adjusted under 35 U.S.C. 154(b) by 199 days.

(21) Appl. No.: 11/424,942

(22) Filed: Jun. 19, 2006

Related U.S. Application Data

(60) Provisional application No. 60/595,920, filed on Aug. 16, 2005, provisional application No. 60/595,868, filed on Aug. 11, 2005.

(51) Int. Cl.
*B65D 25/16* (2006.01)
*B65D 90/04* (2006.01)
*B65D 1/40* (2006.01)

(52) U.S. Cl. ..... 220/495.11; 220/405.06; 220/908.1

(58) Field of Classification Search ..... 220/495.04–495.08, 495.11, 908.1, 501, 220/554, 229; 24/30.5 R
See application file for complete search history.

(56) References Cited

U.S. PATENT DOCUMENTS 3,522,922 A * 8/1970 Byron et al. ..... 248/101
3,825,150 A 7/1974 Taylor
4,457,483 A 7/1984 Gagne
4,535,911 A 8/1985 Goulter
4,570,304 A 2/1986 Montreuil et al.
4,576,310 A 3/1986 Isgar et al.
4,664,347 A 5/1987 Brown et al.
4,763,808 A 8/1988 Guhl et al.
4,834,260 A 5/1989 Auten
4,884,717 A 12/1989 Bussard et al.
4,923,087 A 5/1990 Burrows
4,962,523 A 10/1990 Tanaka
5,031,793 A 7/1991 Chen et al.
5,065,891 A 11/1991 Casey
5,100,087 A 3/1992 Ashby (Continued)

FOREIGN PATENT DOCUMENTS

EP 582240 2/1994

OTHER PUBLICATIONS

Exhibits A, B1, B2, C1, and C2, and corresponding descriptions thereof, as set forth in the Information Disclosure Statement filing by Applicant on Dec. 12, 2006.

*Primary Examiner*—Anthony D Stashick
*Assistant Examiner*—Niki M. Eloshway
(74) *Attorney, Agent, or Firm*—Tillman Wright, PLLC; Chad D. Tillman; James D. Wright

(57) ABSTRACT

A trashcan assembly includes a container having a bottom wall and a peripheral wall extending upwardly from said bottom wall, a rim of said peripheral wall defining an opening extending into said container; and a bag engaging member located in an area of said peripheral wall The bag engaging member includes a housing separate from said peripheral wall, said housing having a surface that is generally parallel to a plane of said peripheral wall in said area and is configured for receiving a portion of a trash bag for securing the trash bag to an outer surface of said peripheral wall. A trash bag may be extended over said rim and secured to said peripheral wall with said bag engaging member.

22 Claims, 9 Drawing Sheets

U.S. PATENT DOCUMENTS 5,222,704 A 6/1993 Light
5,261,553 A 11/1993 Mueller et al.
5,314,151 A 5/1994 Carter-Mann
5,419,452 A 5/1995 Mueller et al.
D362,525 S 9/1995 Kruger
D365,427 S 12/1995 Brightbill
5,501,358 A 3/1996 Hobday
5,611,507 A 3/1997 Smith
5,628,424 A 5/1997 Gola
5,632,401 A 5/1997 Hurd
5,636,416 A 6/1997 Anderson
D381,159 S 7/1997 Hampton
5,645,186 A 7/1997 Powers et al.
5,690,247 A 11/1997 Boover
D387,530 S 12/1997 Doxey
5,695,088 A 12/1997 Kasbohm
5,704,511 A 1/1998 Kellams
5,730,312 A 3/1998 Hung
5,732,845 A 3/1998 Armaly, Jr.
5,735,495 A 4/1998 Kubota
5,738,239 A 4/1998 Triglia
D399,622 S 10/1998 Rashid
D400,331 S 10/1998 Rausch
5,816,431 A 10/1998 Giannopoulos
D401,383 S 11/1998 Gish
5,881,901 A 3/1999 Hampton
5,887,748 A 3/1999 Nguyen
5,987,708 A 11/1999 Newton
6,123,215 A 9/2000 Windle
6,126,031 A 10/2000 Reason
6,234,339 B1 5/2001 Thomas
D445,980 S 7/2001 Tjugum
6,286,706 B1 9/2001 Tucker
6,557,716 B1 5/2003 Chan
6,568,555 B1 * 5/2003 LoCascio ..... 220/495.07
6,659,407 B2 12/2003 Asaro
6,681,950 B2 1/2004 Miller, Jr. et al.
D521,203 S 5/2006 Sofy
7,080,750 B2 7/2006 Wein et al.
7,243,811 B1 7/2007 Ramsey
2001/0002690 A1 6/2001 Rosky
2002/0096524 A1 7/2002 Hardesty
2003/0089719 A1 5/2003 Berger
2004/0200938 A1 10/2004 Forlivio
2005/0017010 A1 1/2005 Siegel et al.
2006/0056741 A1 3/2006 Yang et al.
2008/0011754 A1 1/2008 Ramsey
2008/0011910 A1 1/2008 Ramsey

* cited by examiner

TRASHCAN ASSEMBLY INCLUDING BAG ENGAGING MEMBER

I. CROSS-REFERENCE TO RELATED APPLICATIONS

The present application is a nonprovisional of, and claims priority under 35 U.S.C. § 119(e) to, each of: Ramsey U.S. Provisional Patent Application No. 60/595,868, filed Aug. 11, 2005; and Ramsey U.S. Provisional Patent Application No. 60/595,920, filed Aug. 16, 2005. The entire disclosure of each of these patent applications is hereby incorporated herein by reference.

II. COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

III. BACKGROUND OF THE INVENTION

The use of trashcan devices is known in the prior art. U.S. Pat. No. 6,126,031, which is incorporated herein by reference, describes a device having a bottom compartment for holding a roll of trash bags so that the trash bags may be retrieved as needed through an opening extending into the bottom compartment. Another type of trashcan device is disclosed in U.S. Pat. No. 5,636,416, which is incorporated herein by reference, which device has a conventional shape and which includes clips that are attachable to a trash bag. The clips are positioned outside of the trashcan to prevent the trash bag from falling back into the trashcan. Another clip assembly for securing a trash bag is found in U.S. Pat. No. 5,645,186, which is incorporated herein by reference.

While these devices fulfill their respective, particular objectives and requirements, it is believed that a need remains for a simple trashcan assembly that allows a trashcan liner—sometimes referred to as a trash bag—to be secured directly to the trashcan in order to prevent the trash bag from slipping and falling into the trashcan.

IV. SUMMARY OF THE INVENTION

The present invention includes many aspects and features.

In a first aspect of the invention, a trashcan assembly comprises a container having a bottom wall and a peripheral wall extending upwardly from the bottom wall, a rim of the peripheral wall defining an opening extending into the container, and a bag engaging member located in an area of the peripheral wall with the bag engaging member being generally coplanar with the peripheral wall in the area and being configured for receiving a portion of a trash bag for securing the trash bag to an outer surface of the peripheral wall. A trash bag may be extended over the rim and secured to the peripheral wall with the bag engaging member.

In another aspect of the invention, a trashcan assembly comprises a container having a bottom wall and a peripheral wall extending upwardly from the bottom wall, a rim of the peripheral wall defining an opening extending into the container, a bag engaging member located on the peripheral wall, and a trash bag received within the container and extending over the rim and secured to the peripheral wall with the bag engaging member with a portion of the trash bag extending through the bag engaging member into an interior of the trashcan assembly.

In a feature of this aspect, the trashcan assembly further comprises a trash bag, wherein a portion of the trash bag extends through an aperture of the bag engaging member into an interior of the trashcan assembly. In another feature of this aspect, the trashcan assembly further comprises a plurality of bag engaging members. In accordance with this feature, the plurality of bag engaging members includes two bag engaging members disposed in opposite facing relation with one another. It is preferred that the two bag engaging members are disposed on opposite walls. With regard to this feature, the plurality of bag engaging members includes four bag engaging members. With further regard to this feature, each of the plurality of bag engaging members includes an aperture extending through the peripheral wall and a plurality of slots extending generally radially away from the aperture with a plurality of resiliently flexible sections being defined between adjacent ones of the slots, wherein a portion of the trash bag may be extended into a respective aperture and frictionally secured therein by the sections. In further accordance with this feature, each of the plurality of bag engaging members is biased into a common plane with the peripheral wall. With further regard to the feature, the container is formed of a resilient, semi-flexible plastic, and each of the plurality of bag engaging members includes an arrangement of slits formed in the peripheral wall of the container, wherein portions of a trash bag may be extended into the arrangement of slits and frictionally secured therein by the arrangement. It is preferred that the arrangement of slits includes a star configuration, wherein the slits form fingers that bend inward upon insertion of a portion of a trash bag.

In another feature of this aspect, the trashcan assembly further includes a plurality of tabs, each of the tabs being attached to an inner surface of the peripheral wall with the tabs being spaced from each other and being positioned nearer to the bottom wall than the rim The tabs are configured to secure a trash bag dispensing box adjacent to the bottom wall. In yet another feature of this aspect, the trashcan assembly further comprises a trash bag liner dispenser plate comprising a hinged plate attached to an inner surface of the peripheral wall at a location nearer to the bottom wall than to the rim and having a slot formed therein through which a trash bag liner may be dispensed.

In still yet another feature, the trashcan assembly further comprises a walled compartment disposed adjacent the bottom wall of the container with the compartment containing one or more replacement bag liners therein. In accordance with this feature, the compartment includes a hinging lid and a latch, wherein the lid is lifted for removal or replacement bag liners stored therein. In further accordance with this feature, the compartment includes a lid with a slot formed there through for dispensing of replacement bags. With regard to this feature, the compartment is permanently fixed to the container. With further regard to this feature, the compartment is removably inserted into the container.

In an additional aspect of the invention, a method of making a trashcan assembly configured for receiving a trash bag, comprising the steps of providing a container having a bottom wall and a peripheral wall being attached to and extending upwardly from the bottom wall with a rim of the peripheral wall defining an opening extending into the container; forming an arrangement of slits in the peripheral wall with the arrangement being configured for receiving a portion of the bag and securing the bag to an outer surface of the peripheral wall. A trash bag may be extended over the rim and secured to the peripheral wall by insertion of a portion of the trash bag through the arrangement of slits.

In a feature of this aspect, the arrangement of slits is formed in a star configuration. In another feature of this aspect, the arrangement of slits is formed with a device configured for punching the arrangement in the peripheral wall of the container. In yet another feature of this aspect, the arrangement of slits is formed with a device configured for cutting the arrangement in the peripheral wall of the container.

In an additional feature, the arrangement of slits is formed prior to a consumer purchasing the container. In a further feature, the arrangement of slits is formed by a consumer after the consumer purchases the container. In still yet another feature, the arrangement of slits includes a circular aperture centrally located relative to the slits, each slit extending in a generally radial direction relative to the circular aperture.

In another aspect of the invention, a trashcan comprises a trash bag that has a top end that defines a mouth and a body having a surrounding wall and a top edge that defines a mouth. An opening is provided on the body adjacent the top edge wherein a portion of the trash bag is inserted through the opening of the body.

In a feature of this aspect, the body further includes fingers extending into the opening, with the fingers separated by spaces. In still yet another feature of this aspect, the portion of the trash bag is adjacent the top end of the trash bag.

In an additional aspect of this invention, a method of securing a trash bag to the mouth of a trashcan comprises providing a trashcan having a body having a surrounding wall and a top edge that defines a mouth with an opening provided on the body adjacent the top edge; positioning a trash bag so as to line the trashcan; and inserting a portion of the trash bag through the opening in order to secure the trash bag in lining disposition relative to the trashcan.

In a feature of this aspect, the step of inserting the portion of the trash bag through the opening comprises inserting the portion of the trash bag from an exterior of the trashcan, through the opening, into the interior of the trashcan.

In another aspect of the invention, a trashcan assembly comprises a container having a bottom wall and a peripheral wall extending upwardly from the bottom wall, a rim of the peripheral wall defining an opening extending into the container; and a bag engaging member located in an area of the peripheral wall with the bag engaging member including a housing separate from the peripheral wall with the housing having a surface that is generally parallel to a plane of the peripheral wall in the area and being configured for receiving a portion of a trash bag for securing the trash bag to an outer surface of the peripheral wall. A trash bag may be extended over the rim and secured to the peripheral wall with the bag engaging member.

In yet another aspect of the invention, a trashcan assembly comprises a container having a bottom wall and a peripheral wall extending upwardly from the bottom wall with a rim of the peripheral wall defining an opening extending into the container; and a bag engaging member located on the peripheral wall with the bag engaging member including a housing having an enclosed interior space The bag engaging member is configured for receiving a portion of a trash bag for securing the trash bag to an outer surface of the peripheral wall, wherein the portion of the trash bag extends through a surface of the housing into the enclosed interior space of the bag engaging member, wherein a trash bag may be extended over the rim and secured to the peripheral wall with the bag engaging member.

In a feature of this aspect, the bag engaging member is adhered to the peripheral wall of the container. In another feature of this aspect, the trashcan assembly further comprises a trash bag. The trash bag is received within the container in lining disposition relative to the container, and further is extended over the rim and secured to the peripheral wall by the bag engaging member with a portion of the bag extending into and residing within the enclosed interior space of the bag engaging member.

In an additional feature, the trashcan assembly further comprises a second bag engaging member located on a side wall of the peripheral wall that is opposite to a side wall on which the first bag engaging member is located. In yet another feature, the bag engaging member includes a housing having a lower wall, an upper wall and a perimeter wall being attached to and extending between the lower and upper walls with the perimeter wall including a front wall and a back wall, the front wall having an aperture extending there through with a plurality of slots extending away from the aperture. A plurality of resiliently flexible sections is defined between adjacent ones of the slots, wherein portions of the bag may be extended into the apertures and frictionally secured therein by the sections. An adhesive is attached to and covering each of the back walls with each of the bag engaging members being attached to the peripheral wall with the adhesive.

In another feature, the bag engaging member has a generally box-like shape with a front and back face with the front face having an arrangement of slits formed therein. The arrangement includes a star configuration, wherein portions of the bag may be extended into the arrangement and frictionally secured therein by the arrangement with the back face containing an adhesive for adhering each of the plurality of bag engaging members to the peripheral wall of the container.

In still yet another feature, the trashcan assembly further includes a plurality of tabs with each of the tabs being attached to an inner surface of the peripheral wall The tabs are spaced from each other and are positioned nearer to the bottom wall than the rim with the tabs being configured to secure a trash bag dispensing box adjacent to the bottom wall. In an additional feature, the trashcan assembly further comprises a trash bag liner dispenser plate comprising a hinged plate attached to an inner surface of the peripheral wall at a location nearer to the bottom wall than to the rim and having a slot formed therein through which a trash bag liner may be dispensed.

In another feature, the trashcan assembly further comprises a walled compartment disposed adjacent the bottom wall of the container with the compartment containing one or more replacement bag liners therein. In accordance with this feature, the compartment includes a hinging lid and a latch, wherein the lid is lifted for removal of replacement bag liners stored therein. In further accordance with this feature, the compartment includes a lid with a slot formed there through for dispensing of replacement bags. With regard to this feature, the compartment is permanently fixed to the container. With further regard to this feature, the compartment is removably inserted into the container.

In addition to the aforementioned aspects and features of the present invention, it should be noted that the present invention further includes the various possible combinations of such aspects and features.

V. BRIEF DESCRIPTION OF THE DRAWINGS

Further aspects, features, embodiments, and advantages of the present invention will become apparent from the following detailed description with reference to the drawings, wherein.

VI. DETAILED DESCRIPTION

Figure 1A:
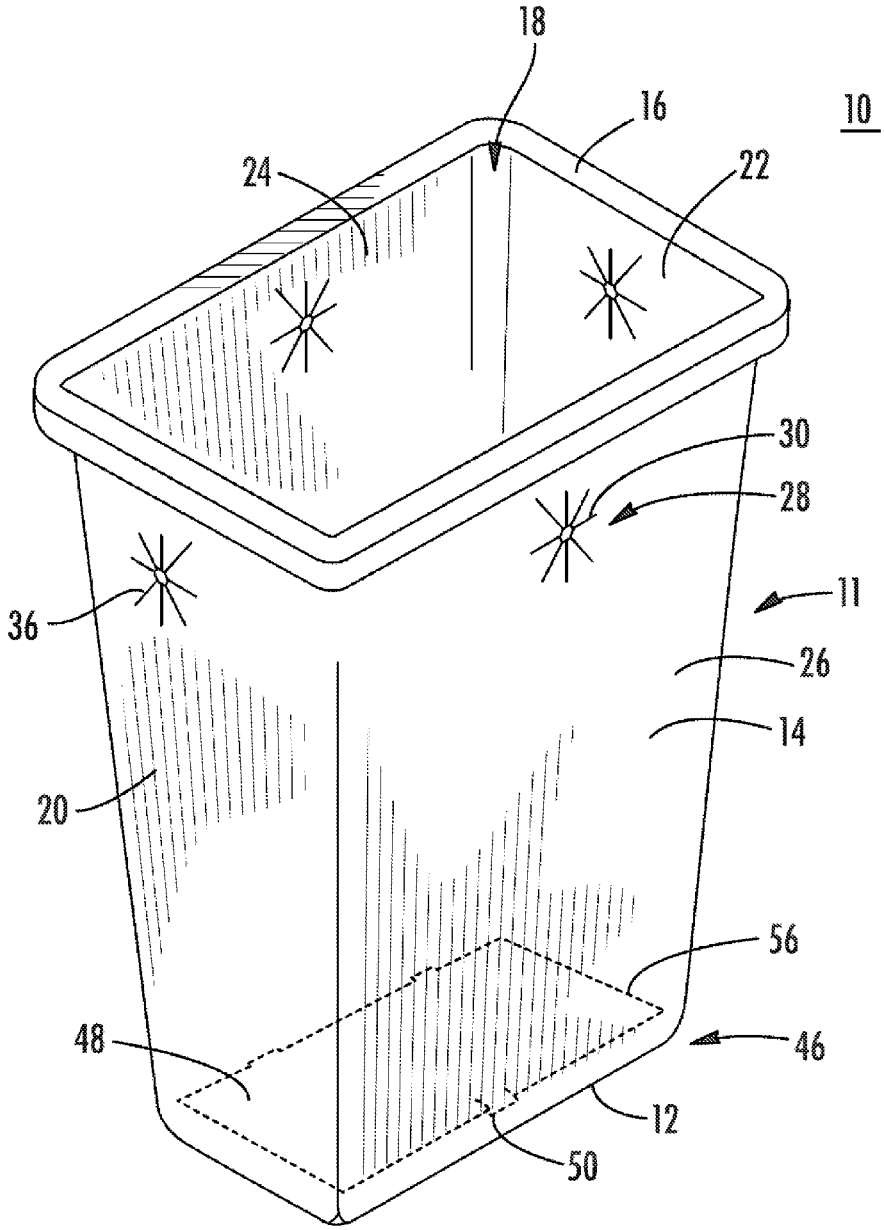
FIG. 1A is a perspective view of a trashcan assembly in accordance with an embodiment of the present invention.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of the preferred embodiment(s) is merely exemplary in nature and is in no way intended to limit the invention, its application, or uses.

Figure 1B:
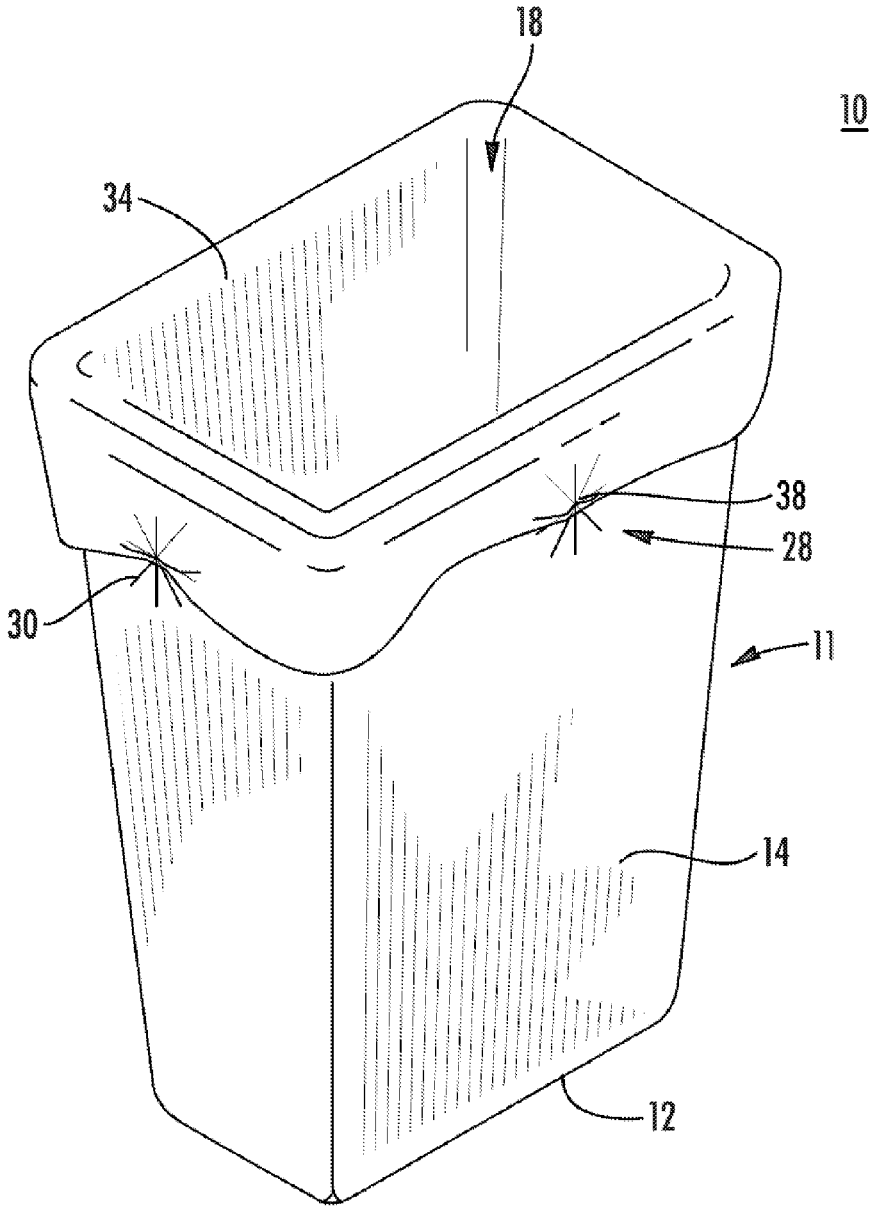
FIG. 1B is a perspective view of the trashcan assembly of FIG. 1A with a plurality of bag engaging members retaining a bag liner.

FIG. 1A is a perspective view of a trashcan assembly 10 in accordance with an embodiment of the present invention. FIG. 1B is a perspective view of the trashcan assembly 10 of FIG. 1A with a plurality of bag engaging members 28 retaining a bag liner 34. The trashcan assembly 10 includes a container 11 having a bottom wall 12 and a peripheral wall 14 that is attached to and extends upwardly from the bottom wall 12. A rim 16 of the peripheral wall 14 defines an opening 18 extending into the trashcan assembly 10. The peripheral wall 14 includes a first wall 20, a second wall 22, a third wall 24 and a fourth wall 26 wherein the first 20 and second walls 22 are positioned opposite of each other.

In FIG. 1A, the trashcan assembly 10 is formed from a resilient, semi-flexible plastic material and includes one or more bag engaging members 28 including arrangements of slits 30 within one or more walls thereof. Preferably, each arrangement 30 includes a star configuration and is disposed in proximity to the rim 16 of the trashcan assembly 10. Due to the flexibility of the material and the orientation of the slits in each arrangement 30, an opening 32 inward may be formed at each arrangement 30 for insertion and retention therein of a bag liner 34. The slits form fingers 36 or teeth that bend inward upon insertion of the bag liner 34 and that resist withdrawal of the bag liner 34 when the force used to bend the fingers 36 inwardly is removed. Indeed, the fingers 36 preferably return to their original position when the force is withdrawn. By inserting the bag liner 34 into the trashcan assembly 10 and extending the top of the bag liner 34 over the rim 16 of the trashcan assembly 10, portions 38 of the top of the bag liner 34 may be inserted into and retained by the arrangement 30 of fingers 36. The portion 38 of the bag liner 34 is thereby retained in its extension over the rim 16 of the trashcan assembly 10, and the bag liner 34 is thereby prevented from falling down within the trashcan assembly 10.

The present invention further includes a method of manufacturing a trashcan assembly 10 by forming the arrangement of slits 30 in the trashcan assembly 10 as shown. The arrangement 30 may be formed with the manufacture of the trashcan or formed thereafter. The arrangement 10 further may be formed even after purchase of the trashcan by a consumer. In this regard, an aspect of the invention includes a device for punching or cutting an arrangement of slits 30 for retention of a bag liner 34 as disclosed with respect to the trashcan assembly 10. The device preferably acts as a punch for forming the arrangement of slits 30 in the trashcan 11. Each arrangement of slits 30 is formed one at a time by the consumer in the desired locations in proximity to the rim 16 of the trashcan 11.

In alternative embodiments, the trashcan assembly 10 may include one, two, three, four or more sides each having one or more arrangements of slits 30 for retention of the bag liner 34. For example, the trashcan assembly 10 may include just two opposing arrangements of slits 30 disposed, respectively, in walls 20,22.

Figure 2A:
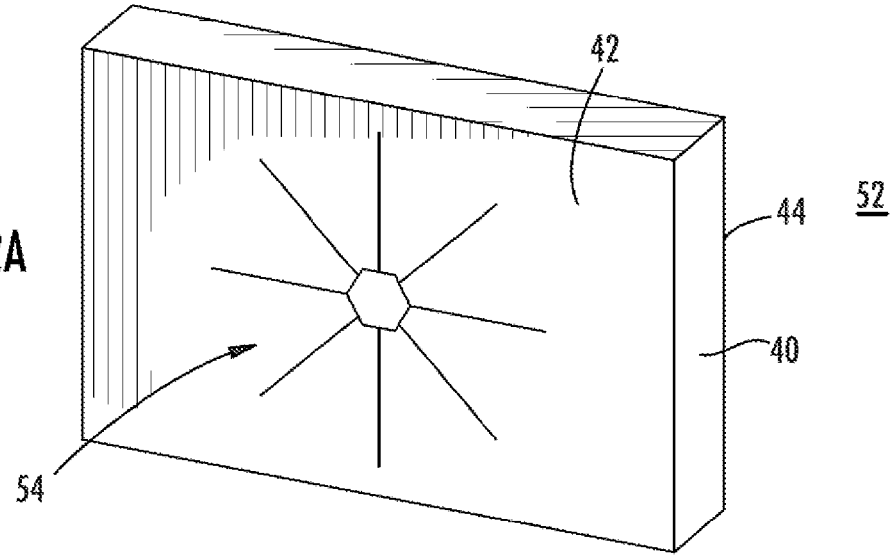
FIG. 2A is a perspective view of a bag engaging member in the form of a stick-on retention device for retaining a portion of a bag liner in accordance with another embodiment of the present invention.
Figure 2B:
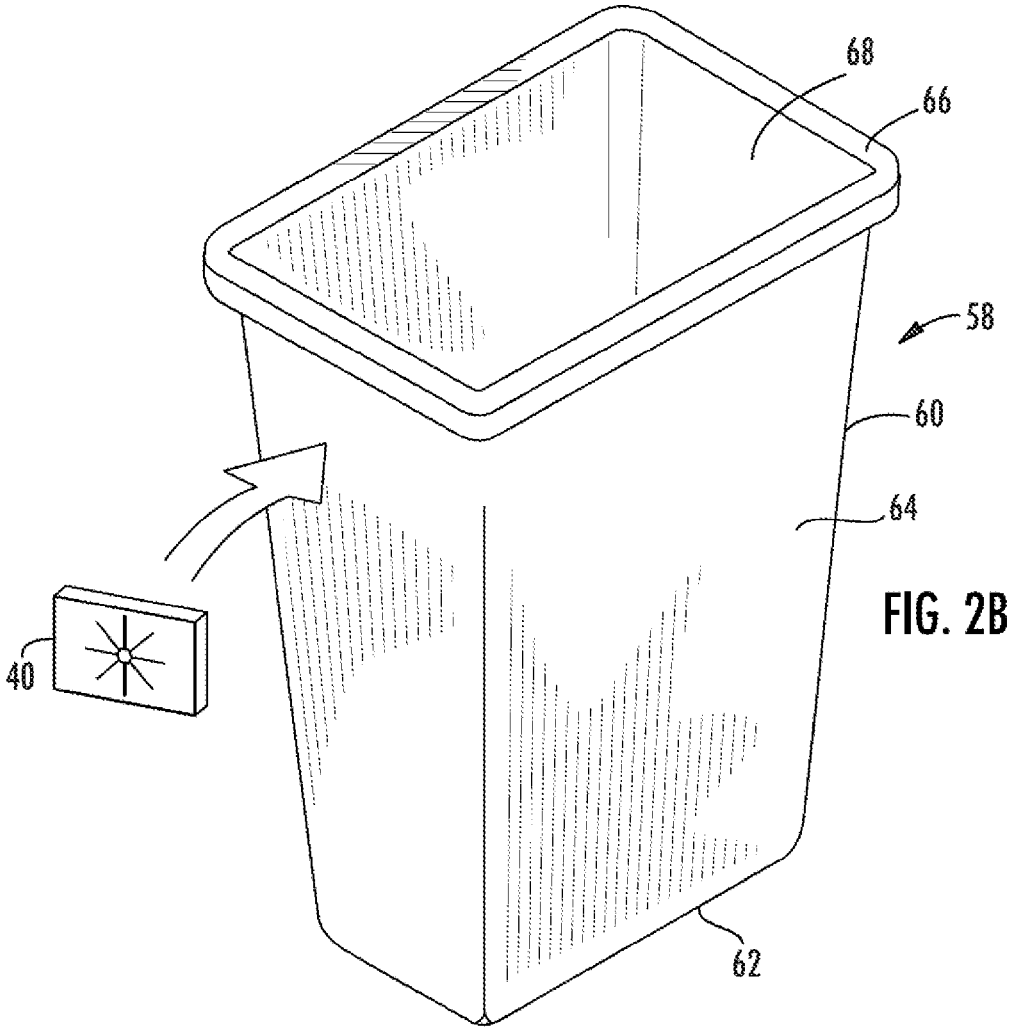
FIG. 2B is a perspective view of a conventional trashcan and the stick-on retention device of FIG. 2A illustrating attachment of the stick-on retention device to a trashcan.

FIG. 2A is a perspective view of a bag engaging member 52 in the form of a stick-on retention device 40 for retaining a portion 38 of a bag liner 34 in accordance with another embodiment of the present invention. FIG. 2B is a perspective view of a conventional trashcan 58 and the stick-on retention device 40 of FIG. 2A illustrating attachment of the stick-on retention device 40 to the trashcan 58. A conventional trashcan 58 generally includes a container 60 having a bottom wall 62 and a peripheral wall 64 that is attached to and extends upwardly from the bottom wall 62. A rim 66 of the peripheral wall 64 defines an opening 68 extending into the trashcan 58. The stick-on device 40 is generally box-like in shape with a front face 42 and a back face 44. The front face 42 has an arrangement of slits 54 formed therein. Each stick-on device 40 includes at least one arrangement of slits 54 for receiving and retaining a portion 38 of a bag liner 34. Similar to the arrangement of slits 30 described herein above, the arrangement of slits 54 in the stick-on device includes a star configuration. The back face 44 of the stick-on device 40 contains an adhesive for adhering the device 40 to the peripheral wall 64 of the trashcan 58. The Ordinary Artisan will understand that any suitable adhesive may be used to adhere the stick-on device to the trashcan.

Preferably, each device 40 is capable of adhering to a conventional trashcan 58 and includes at least one arrangement of slits 54 for receiving and retaining a portion 38 of a trash bag liner 34. The stick-on device 40 is advantageous for retrofitting a conventional trashcan 58 in which the arrangements of slits 54 cannot be formed or in which a user does not wish to physically form the arrangements of slits 54.

Returning to FIG. 1A, the trashcan assembly 10 optionally includes a refill compartment 46 disposed adjacent the bottom wall 12 of the container 11 that contains therein one or more replacement bag liners. The compartment 46 has a walled housing 56 and preferably includes a hinging lid 48 and latch 50. Alternatively, the refill bag liners may be withdrawn through one or more slots formed in the lid of the compartment (not shown) as is conventional for dispensers for trash bag liners. The compartment may be permanently fixed to or integrally formed with the trashcan assembly. Alternatively, the compartment may be removably inserted into the trashcan.

Figure 3:
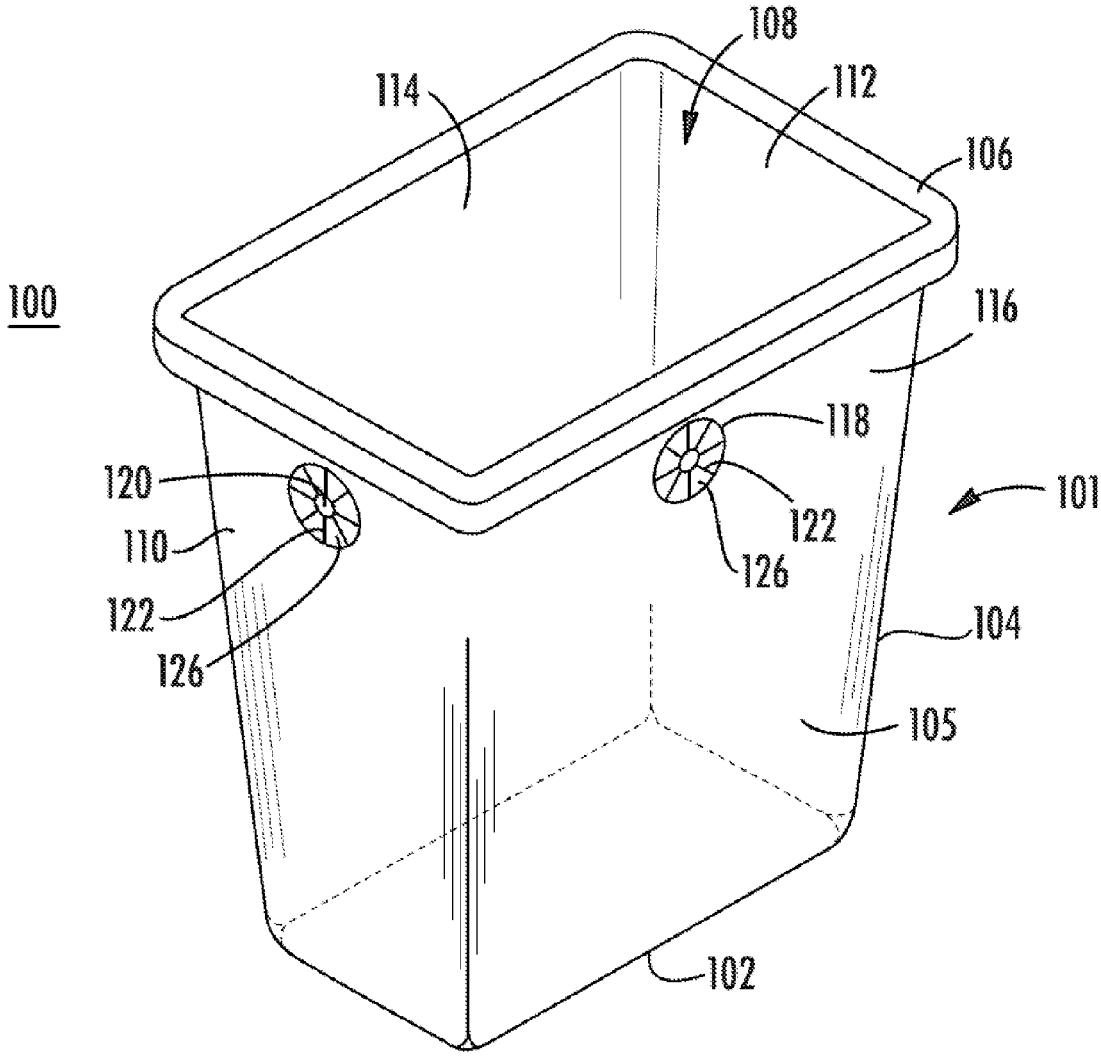
FIG. 3 is a perspective view of a trashcan assembly in accordance with an embodiment of the present invention.
Figure 4:
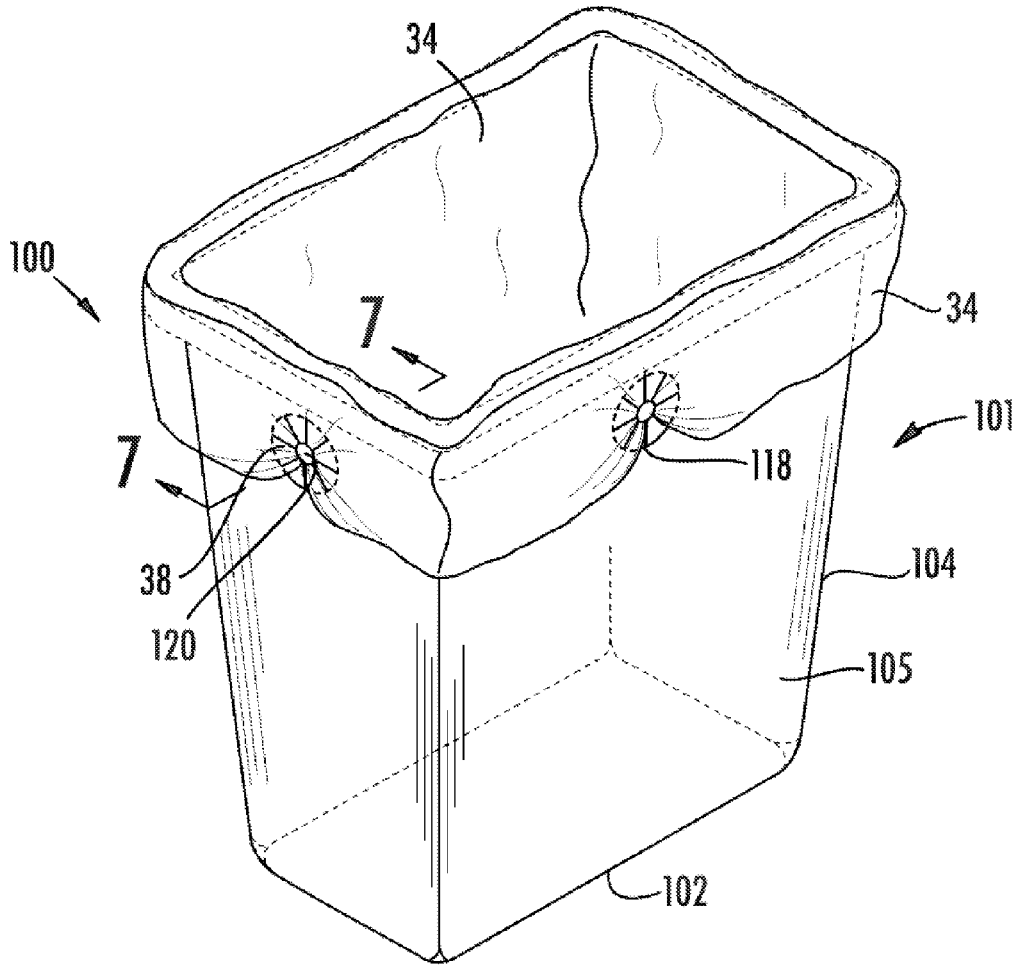
FIG. 4 is a perspective view of the trashcan assembly of FIG. 3 with a trash bag liner inserted and retained therein.
Figure 7:
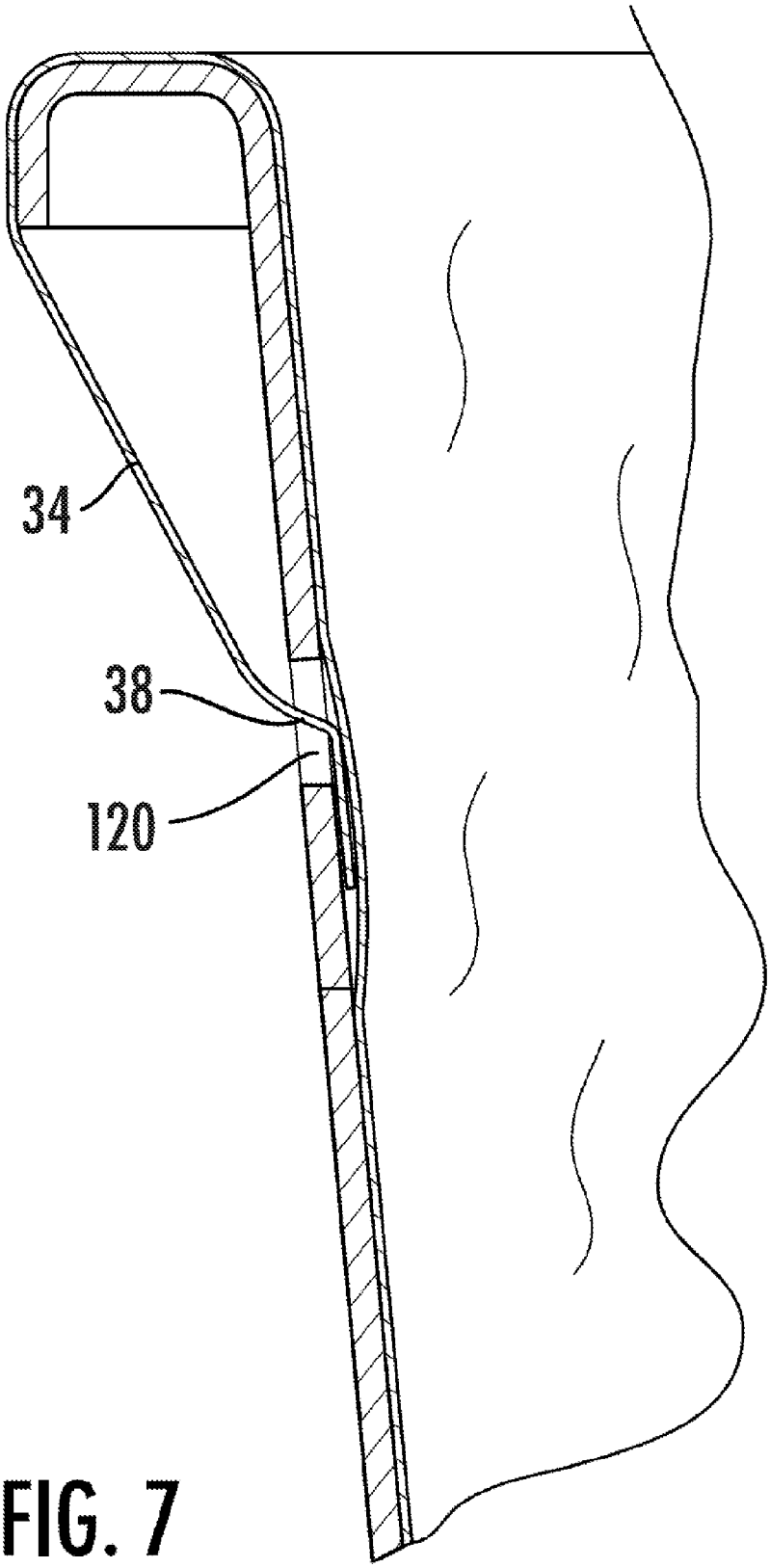
FIG. 7 is a side cross-sectional view taken along the line 7-7 in FIG. 4.

FIG. 3 is another perspective view of a trashcan assembly 100 in accordance with an embodiment of the present invention, and FIG. 4 is a perspective view of the trashcan assembly 100 of FIG. 3 with a trash bag liner 34 inserted and retained therein. FIG. 7 is a side cross-section view of a bag engaging member 118 taken along the line 7-7 in FIG. 4, which bag engaging member 118 serves to retain the trash bag liner 34. The trashcan assembly 100 generally comprises a container 101 that has a bottom wall 102 and a peripheral wall 104 that is attached to and extends upwardly from the bottom wall 102. A rim 106 of the peripheral wall 104 defines an opening 108 extending into the container 101. The peripheral wall 104 includes a first wall 110, a second wall 112, a third wall 114 and a fourth wall 116 wherein the first and second walls 110,112 are positioned opposite of each other.

A plurality of bag engaging members 118 are positioned on the peripheral wall 104. Each of the bag engaging members 118 is configured for receiving a portion 38 of a trash bag liner 34, preferably a pliable plastic trash bag, and secures the bag 34 to an outer surface 105 of the peripheral wall 104. Each of the bag engaging members 118 includes an aperture 120 extending through the peripheral wall 104 and a plurality of slots 122 extending radially away from the aperture 120. A plurality of resiliently flexible sections 126 is defined between adjacent ones of the slots 122. Because the sections 126 are resiliently flexible, the sections 126 are biased into a common plane with the peripheral wall 104. Portions 38 of the bag 34 may be extended into the apertures 120 and frictionally secured therein by the sections 126. The plurality of bag engaging members 118 preferably includes at least two bag engaging members and, in other embodiments, preferably one engaging member is located on each of the first, second, third and fourth walls. However, in contemplated variations of the invention, a single bag engaging member 118 may be utilized.

Figure 5:
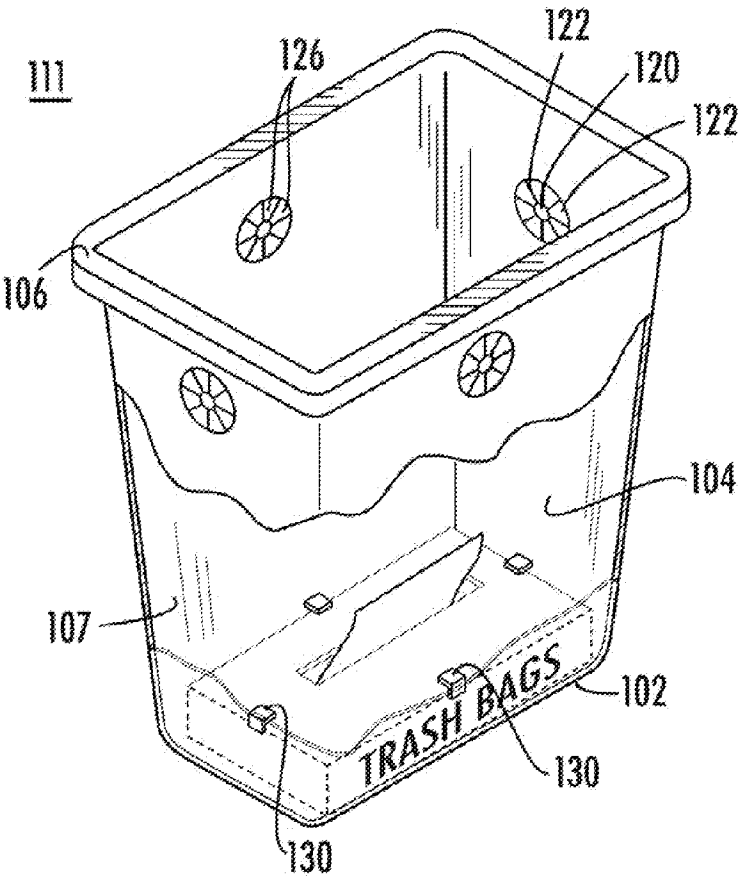
FIG. 5 is a partially cut-away perspective view of a trashcan assembly similar to that of FIGS. 3 and 4, but having a plurality of tabs disposed on an inner surface of the peripheral wall for retaining a trash bag liner dispenser.

FIG. 5 is a partially cut-away perspective view of a trashcan assembly 111. The trashcan assembly 111 is similar to that of FIGS. 3 and 4, but further includes a plurality of tabs 130 disposed on an inner surface 107 of the peripheral wall 104. Each of the tabs 130 is attached to an inner surface 107 of the peripheral wall 104. The tabs 130 are spaced apart from each other and are positioned nearer to the bottom wall 102 than the rim 106. The tabs 130 are configured and arranged to secure a trash bag dispensing box adjacent to the bottom wall 102. The box is positioned on the bottom wall 102 and bags are removed from the box while the box is retained on the bottom wall 102 by the tabs 130. It is preferred that the box be a conventional dispensing box of the type purchased at a grocery store or other retail establishment such as Wal-Mart, Target or K-Mart.

Figure 6:
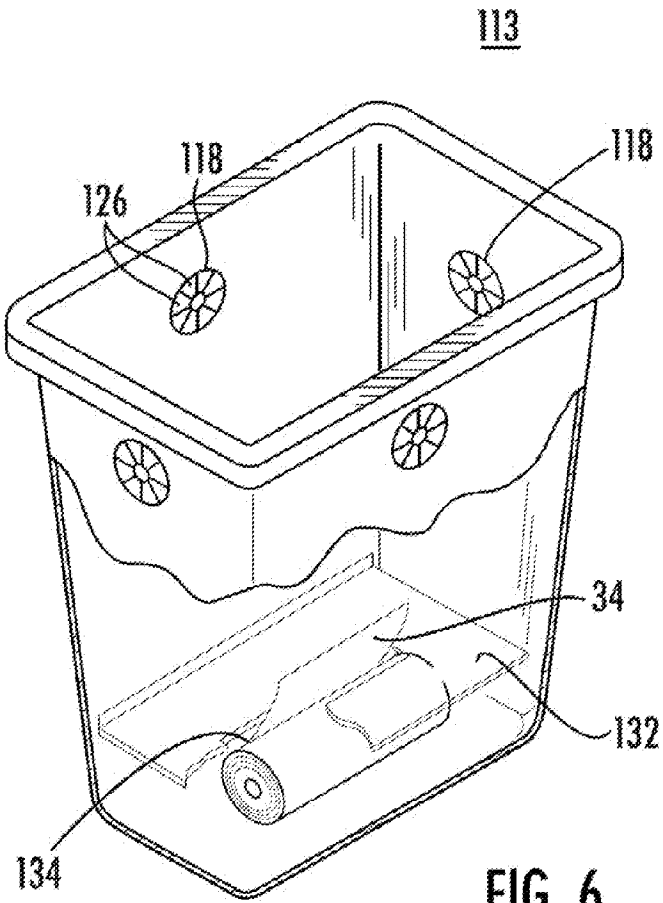
FIG. 6 is a partially cut-away perspective view of a trashcan assembly similar to that of FIG. 3 but having an alternative design accommodating a trash bag liner dispenser.

FIG. 6 is a partially cut-away perspective view of a trashcan assembly similar to that of FIG. 5, but having an alternative design accommodating a trash bag liner dispenser. Specifically, the trashcan assembly 113 of FIG. 6 includes a hinged plate 132 attached to the inner surface 107 of the peripheral wall 104 for holding down a trash bag dispensing box. The hinged plate 132 has a slot 134 formed therein through which a trash bag liner 34 may be dispensed.

Figure 8:
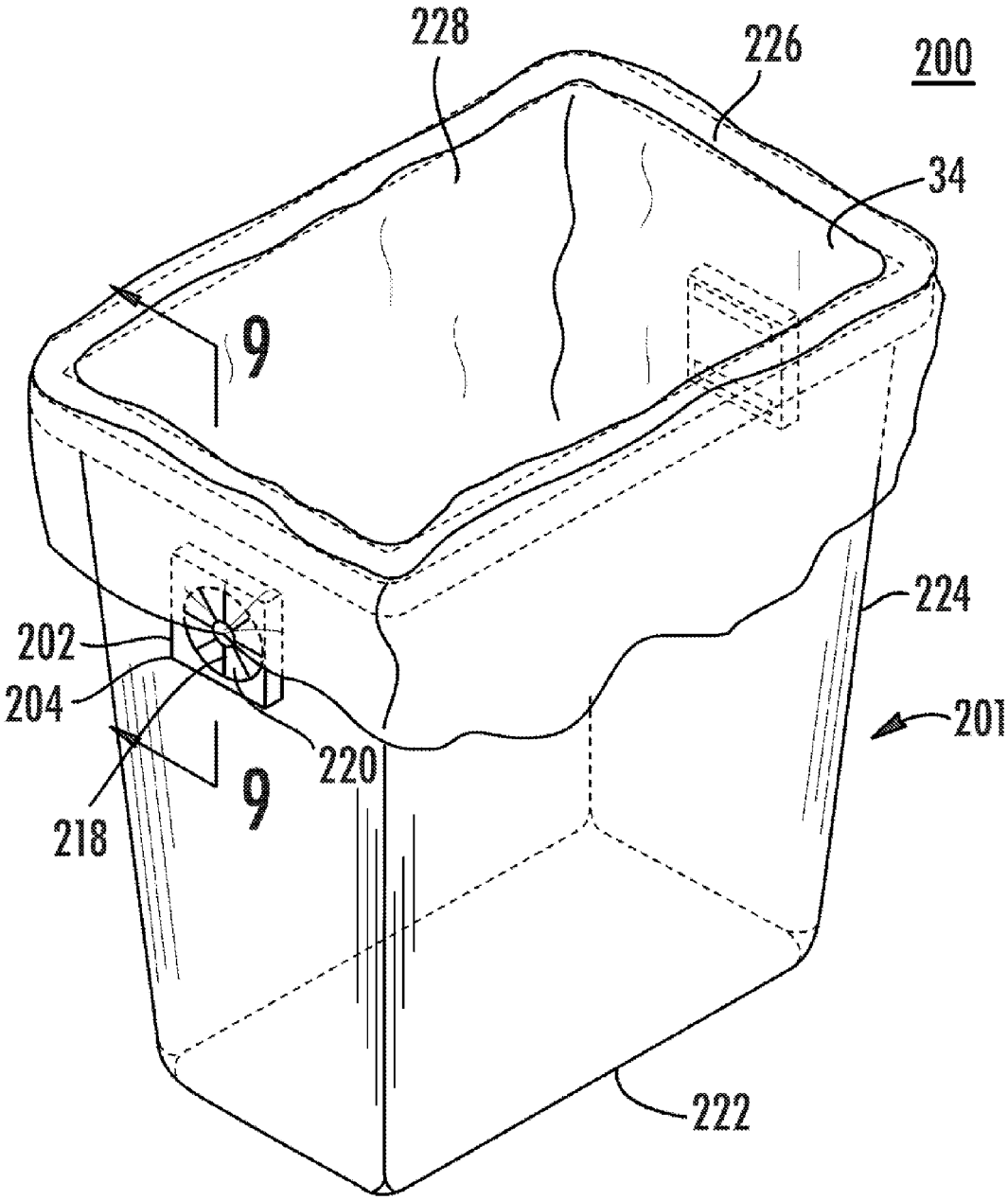
FIG. 8 is a perspective view of a trashcan assembly in accordance with an embodiment of the present invention.
Figure 9:
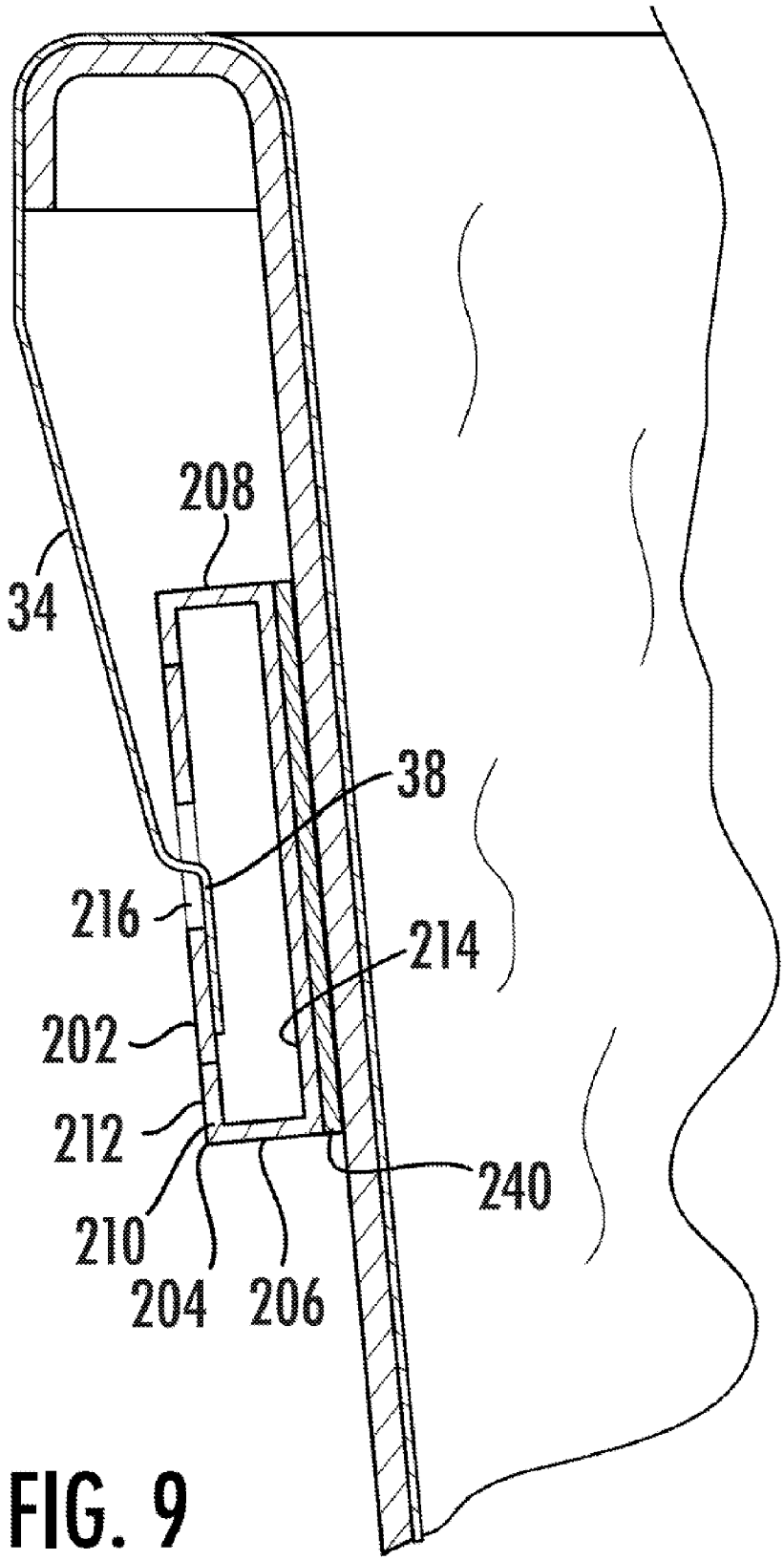
FIG. 9 is a side cross-sectional view taken along the line 9-9 in FIG. 8.

FIG. 8 is another perspective view of a trashcan assembly 200, and FIG. 9 is a side cross-sectional view of an alternative embodiment of a bag engaging member 202 taken along the line 9-9 in FIG. 8. The trashcan assembly 200 generally comprises a container 201 that has a bottom wall 222 and a peripheral wall 224 that is attached to and extends upwardly from the bottom wall 222. A rim 226 of the peripheral wall 224 defines an opening 228 extending into the container 201.

The bag engaging member 202 includes a housing 204 having a lower wall 206, an upper wall 208, and a perimeter wall 210 that is attached to and extends between the lower 206 and upper walls 208. The perimeter wall 210 includes a front wall 212 and a back wall 214. The front wall 212 has an aperture 216 extending there through. A plurality of slots 218 extends away from the aperture 216 in radial directions, and a plurality of resiliently flexible sections 220 is defined between adjacent ones of the slots 218. Portions 38 of a bag liner 34 may be extended into the respective apertures 216 of the two bag engaging members 202 and frictionally secured therein by the resiliently flexible sections 220. An adhesive is attached to and covers each of the back walls 214. The bag engaging members 202 are attached to the peripheral wall 224 of the container 201 with the adhesive.

Generally, in use in accordance with the present invention, a trash bag 34 is placed in a respective container 11,60,101, 201 and extended over a respective rim 16,66,106,226. The trash bag 34 may then be secured to a respective peripheral wall 14,64,104,224 with one or more respective bag engaging members 28,52,118,202. The bag engaging members 28,52, 118,202 prevent the trash bag 34 from falling into the container 11,60,101,201, even when trash is placed within the container 11,60,101,201 with great force.

With respect to the above description, it is to be realized that the optimum dimensional relationships for the parts of the invention, to include variations in size, materials, shape, form, function and manner of operation, assembly and use, and all equivalent relationships to those illustrated in the drawings and described in the specification, are intended to be encompassed by the present invention.

A trashcan assembly in accordance with the invention may be utilized as a residential trash container such as, for example, trash containers found in kitchens. A trashcan assembly in accordance with the invention may also be used for commercial trash containers such as, for example, trash containers found in offices. The trashcan assembly further has utility in use in large trash containers for receiving and holding yard debris such as leaves, and has particularly utility when bagging leaves.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A trashcan assembly, comprising:

(a) a container having a bottom wall and a peripheral wall extending upwardly from said bottom wall, a rim of said peripheral wall defining an opening extending into said container; and (b) a bag engaging member located on said peripheral wall, said bag engaging member including a housing having a lower wall, an upper wall, and a perimeter wall attached to and extending between said lower wall and said upper wall, said perimeter wall including a front wall having an aperture and a plurality of slots extending away from said aperture and defining a plurality of resiliently flexible sections such that a portion of a trash bag may be extended through said aperture and frictionally secured therein by said resiliently flexible sections, whereby a trash bag may be extended over said rim and secured to said peripheral wall with said bag engaging member.

2. The assembly according to claim 1, wherein said perimeter wall further includes a back wall of said bag engaging member that is adhered to said peripheral wall of said container.

3. The assembly according to claim 2, wherein said housing includes an enclosed interior space defined by said lower wall, said upper wall, and said perimeter wall.

4. The assembly according to claim 1, further comprising a trash bag, wherein said trash bag is received within said container in lining disposition relative to said container, and further is extended over said rim and secured to said peripheral wall by said bag engaging member, a portion of said bag extending through said aperture and being frictionally secured therein by said resiliently flexible sections of said bag engaging member.

5. The assembly according to claim 1, further comprising a second bag engaging member located on a side wall of said peripheral wall that is opposite to a side wall of said peripheral wall on which said first bag engaging member is located, said second bag engaging member being structurally identical to said first bag engaging member.

6. The assembly according to claim 1, further including a plurality of tabs, each of said tabs being attached to an inner surface of said peripheral wall, said tabs being spaced from each other and being positioned nearer to said bottom wall than said rim, said tabs being configured to secure a trash bag dispensing box adjacent to said bottom wall.

7. The assembly of claim 1, further comprising a walled compartment located adjacent the bottom wall of the container, said compartment containing one or more replacement bag liners therein.

8. The assembly of claim 7, wherein said compartment includes a hinging lid and a latch, wherein said lid is lifted for removal of replacement bag liners stored therein.

9. The assembly of claim 7, wherein said compartment includes a lid with a slot formed there through for dispensing of replacement bags.

10. A trashcan assembly, said assembly comprising:

(a) a container having a bottom wall and a peripheral wall extending upwardly from said bottom wall, a rim of said peripheral wall defining an opening extending into said container; and (b) a bag engaging member located on said peripheral wall, said bag engaging member having a generally box-like shape with a front face and a back face, said front face having an arrangement of slits formed therein such that a portion of a trash bag may be extended through said arrangement of slits and frictionally secured by said arrangement of slits, whereby a trash bag may be extended over said rim and secured to said peripheral wall with said bag engaging member.

11. The assembly of claim 10, wherein said arrangement of slits includes a star configuration.

12. The assembly of claim 10, wherein said back face contains an adhesive for adhering said bag engaging member to said peripheral wall of said container.

13. The assembly of claim 10, wherein said box-like shape of said bag engaging member defines an enclosed interior space that is accessible through said aperture and said arrangement of slits.

14. The assembly according to claim 10, further comprising a trash bag, wherein said trash bag is received within said container in lining disposition relative to said container, and further is extended over said rim and secured to said peripheral wall by said bag engaging member, a portion of said bag extending through said aperture and being frictionally secured therein by said resiliently flexible sections of said bag engaging member.

15. The assembly according to claim 10, further comprising a second bag engaging member located on a side wall of said peripheral wall that is opposite to a side wall of said peripheral wall on which said first bag engaging member is located, said second bag engaging member being structurally identical to said first bag engaging member.

16. A trashcan assembly comprising:

(a) a container having a bottom wall and a peripheral wall extending upwardly from said bottom wall, a rim of said peripheral wall defining an opening extending into said container; and (b) a bag engaging member located in an area of said peripheral wall, said bag engaging member including a housing separate from said peripheral wall, said housing having a surface that is generally parallel to a plane of said peripheral wall in said area, said surface including an aperture and a plurality of slots extending away from said aperture and defining a plurality of resiliently flexible sections such that a portion of a bag may be extended through said aperture and frictionally secured therein by said resiliently flexible sections, whereby a trash bag may be extended over said rim and secured to said peripheral wall with said bag engaging member.

17. The assembly according to claim 16, wherein said housing of said bag engaging member is adhered to said peripheral wall of said container.

18. The assembly according to claim 16, further comprising a trash bag, wherein said trash bag is received within said container in lining disposition relative to said container, and further is extended over said rim and secured to said peripheral wall by said bag engaging member, a portion of said bag extending through said aperture and being frictionally secured therein by said resiliently flexible sections of said bag engaging member.

19. The assembly according to claim 16, further comprising a second bag engaging member located on a side wall of said peripheral wall that is opposite to a side wall of said peripheral wall on which said first bag engaging member is located, said second bag engaging member being structurally identical to said first bag engaging member.

20. The assembly according to claim 16, wherein said housing includes an enclosed interior space that is accessible through said aperture and said arrangement of slots.

21. A trashcan assembly comprising:

(a) a container having a bottom wall and a peripheral wall extending upwardly from said bottom wall, a rim of said peripheral wall defining an opening extending into said container; and (b) a bag engaging member located in an area of said peripheral wall, said bag engaging member comprising a component separate from said peripheral wall and having a surface that is generally parallel to a plane of said peripheral wall in said area, said surface including an aperture and a plurality of slots extending away from said aperture, said slots defining a plurality of resiliently flexible sections between adjacent ones of said slots such that a portion of a bag may be extended through said aperture and frictionally secured therein by said resiliently flexible sections, whereby a trash bag may be extended over said rim and secured to said peripheral wall with said bag engaging member;

(c) wherein said resilient flexible sections do not include pointed ends all converging at a common point.

22. The assembly according to claim 16, wherein said bag engaging member is adhered to said peripheral wall of said container.

* * * * *